US005651710A

United States Patent [19]

Rives et al.

[11] Patent Number: 5,651,710

[45] Date of Patent: Jul. 29, 1997

[54] SWIM AND EXERCISE HAND PADDLES

[76] Inventors: R. Kelly Rives, 1119 Ben Hur, Houston, Tex. 77055; Ronald G. Presswood, Jr., 4002 Milton, Bellaire, Tex. 77005

[21] Appl. No.: 634,960

[22] Filed: Apr. 19, 1996

[51] Int. Cl.[6] ..... A63B 31/10

[52] U.S. Cl. ..... 441/58; 441/56

[58] Field of Search ..... 441/55, 56, 57, 441/58, 59, 60, 61, 62, 63, 64

[56] References Cited

U.S. PATENT DOCUMENTS

| | | | |
|---|---|---|---|
| 894,311 | 7/1908 | Brenton | 441/58 |
| 4,913,418 | 4/1990 | Schlueter et al. | 441/56 |
| 5,304,080 | 4/1994 | Dilger | 441/58 |
| 5,511,998 | 4/1996 | Johnson | 441/58 |

*Primary Examiner*—Stephen Avila

*Attorney, Agent, or Firm*—Gilbreth & Strozier, P.C.; Robert W. Strozier; J. Mark Gilbreth

[57] ABSTRACT

A swimmer's flexible hand paddle is disclosed which includes a raised portion centered under a swimmer's hand extending from near a first finger joint to a palm position of the paddle and a flat portion extending from the raised portion out past a outline of a swimmer's hand having thumb, little finger and finger tip off-set. The raised portion is substantially straight across a finger edge and tapers of a V-shaped palm edge. The raised portions has shoulders that slope down to the flat portion with the thumb side shoulder forming a thumb rest. A palm piece is also disclosed which is attachable to prior art paddles and provides the raised portion to prior art paddles.

20 Claims, 8 Drawing Sheets

FIG. 4C
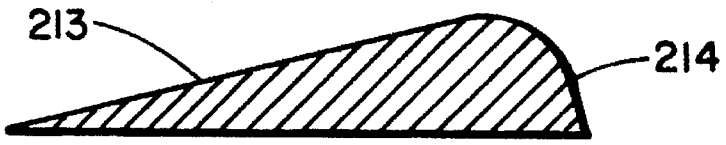
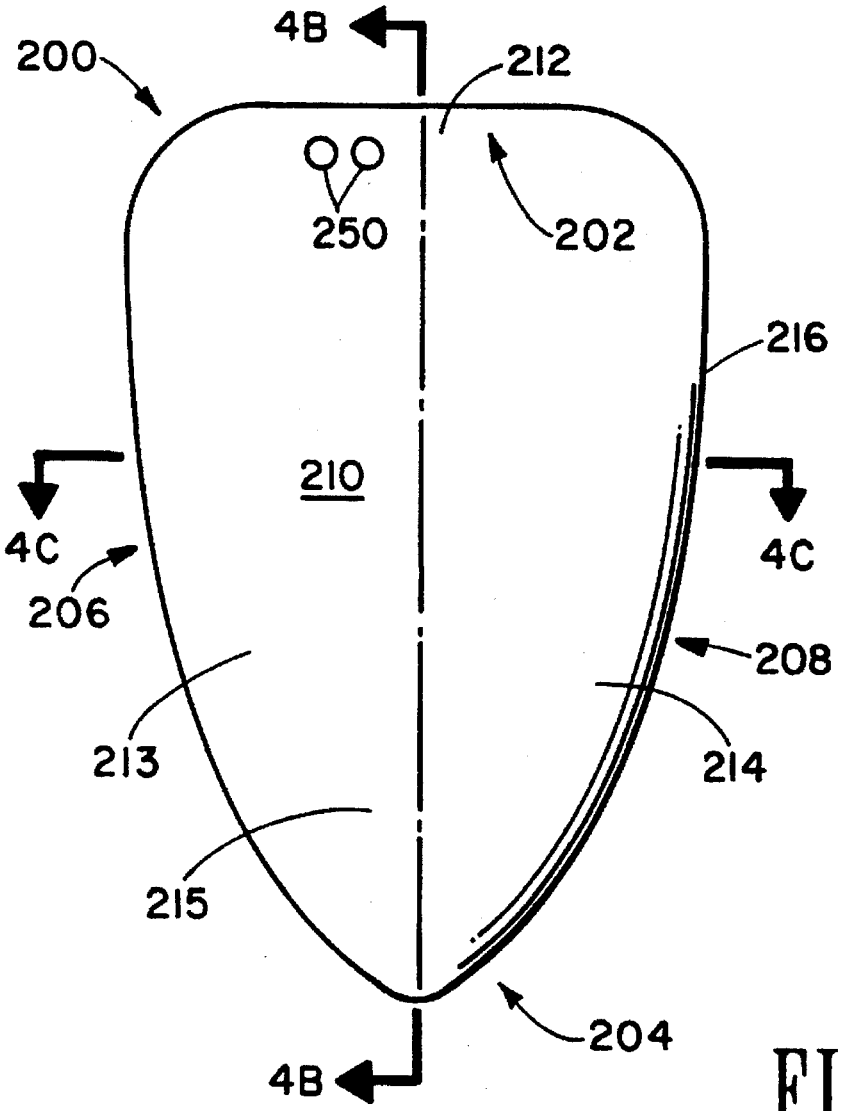
FIG. 4A
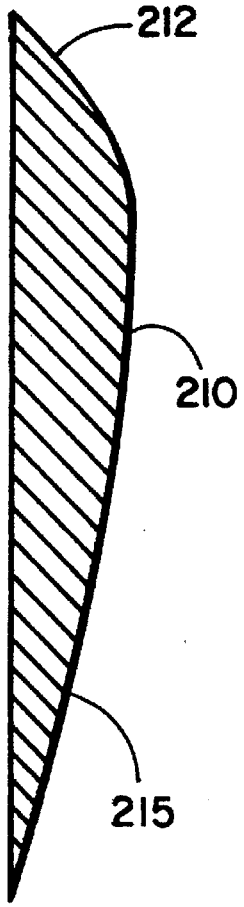
FIG. 4B

FIG. 5C
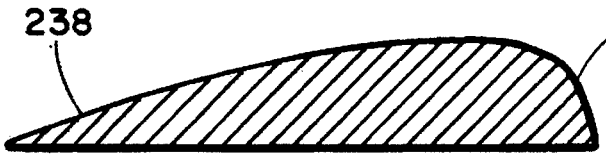
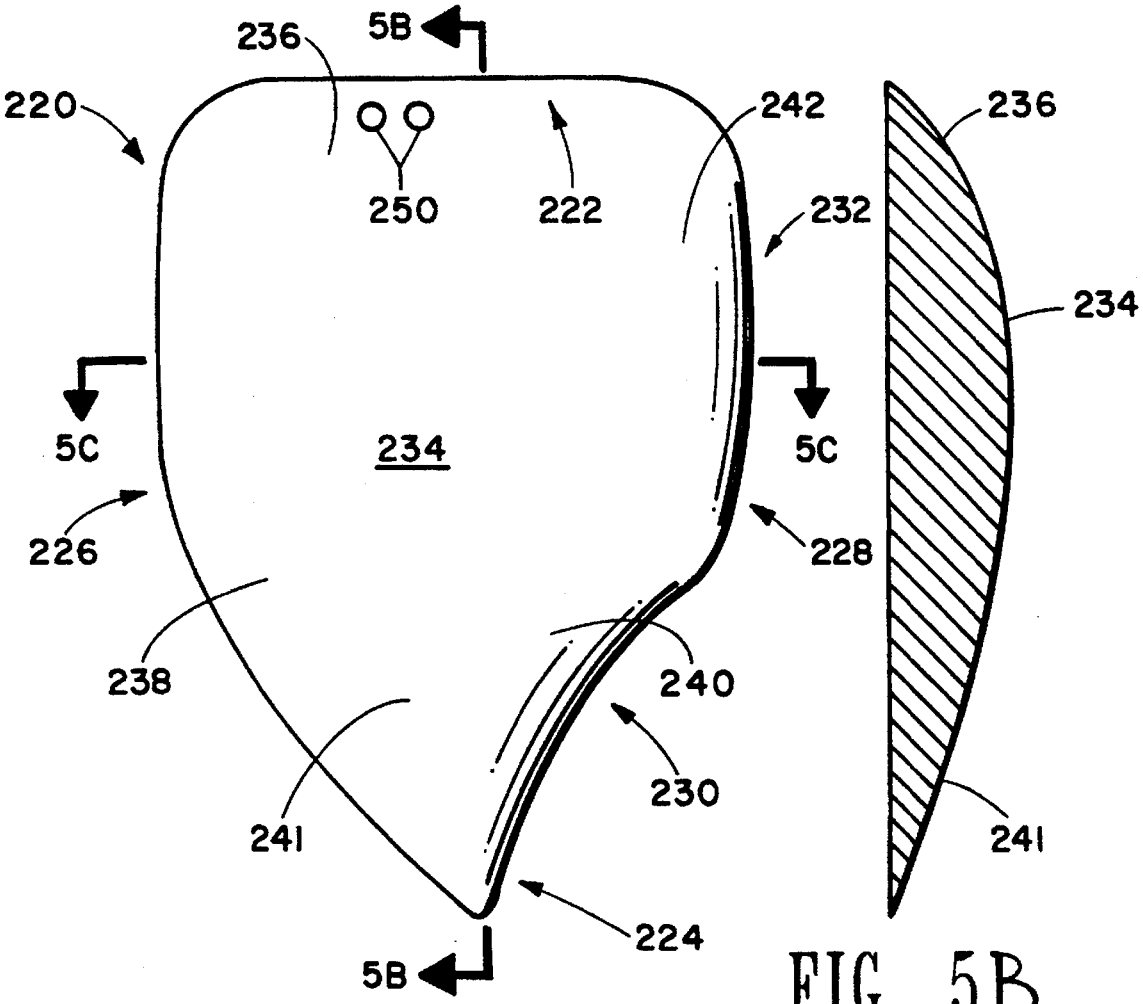
FIG. 5B
FIG. 5A

SWIM AND EXERCISE HAND PADDLES

FIELD OF THE INVENTION

This invention relates to hand paddles as training aids for swimmers to improve stroke and muscle tone.

More particularly, the invention relates to training paddles used to increase stroke resistance and increase strength in swimmers, where the paddles include a raised section extending from a finger position on the paddle to a palm position on the paddle and tapering from the finger position to the palm position.

BACKGROUND OF THE INVENTION

Several paddle shaped swimming aids are currently available. Some of these paddles include solid hand-sized or larger rectangular paddles made of plastic materials provided with a finger loop and an optional wrist loop for securing the paddle to the hand. Although this type of paddle does increase resistance, this type of paddle may put undue stress on the shoulders of the swimmer, particularly the rotator cuff.

Other paddles include arrays of perforations covering essentially the entire surface of the paddle which decreases resistance and gives a more normal "feel" of the water. Still other paddles include solid surface, hand-sized paddle with rounded corners. Usually such paddles are provided with finger and wrist loops to secure them to the hand.

Another type of paddle is disclosed in U.S. Pat. No. 4,913,418 which is an oversized, somewhat oval-shaped paddle having perforations in the hand area of the paddle and finger and wrist straps and incorporated herein by reference. Additionally, TYR Sport, Inc. of Hunnington Beach, Calif. has introduced a new paddle with a large opening centered over the hand, crossing finger straps and a wrist strap.

However, these paddles do not provide a means for properly positioning the hand on the paddle and/or a means for forcing and maiming the hand in a proper form to maximum stroke efficiency in free swimming. Thus, there is a need for a paddle that provides for improved hand positioning on the paddle and proper hand form during each stroke as well as providing increased resistance and improved muscle development.

SUMMARY OF THE INVENTION

The present invention provides a hand paddle having a shape designed to accommodate a human hand which includes a substantially flat first portion that extends past an outline of the hand and a raised second portion extending from a finger position located near a first finger joint of a hand positioned properly on the paddle to a palm position of the paddle and where the raised portion tapers from the finger position to the palm position and where the raised portion is designed to properly position the hand on the paddle, to shape the hand in a proper form to maximize stroke efficiency, and to provide better paddle-hand contact and better paddle control.

The paddle also includes a first plurality of perforations to accommodate a single finger strap and double finger strap where the double finger strap is preferably closer to a palm portion of the paddle than the single strap and where the straps are designed to secure the hand to the paddle and an optional second plurality of perforation to allow water to pass therethrough reducing or augmenting the paddle's resistance as it is pushed through the water.

The present invention also provides an attachable palm piece including a plurality of protrusion designed to allow the palm piece to be attached to a flat swim paddle of the prior art by inserting the protrusions in the palm piece in mating holes or perforation is the prior art paddles.

BRIEF SUMMARY OF THE DRAWINGS

For a more complete understanding of the present invention and the features and advantages thereof, reference is now made to the Detailed Description in conjunction with the attached Drawings, in which:

FIG. 4*a* is a top view of one embodiment of a palm piece of the present invention;

FIG. 4*b* is a cross-sectional view of the palm piece of FIG. 1 along line 4—4;

FIG. 4*c* is a cross-sectional view of the palm piece of FIG. 1 along line 4'—4';

FIG. 5*a* is a top view of a second embodiment of a palm piece of the present invention;

FIG. 5*b* is a cross-sectional view of the palm piece of FIG. 1 along line 5—5; and FIG. 5*b* is a cross-sectional view of the palm piece of FIG. 1 along line 5'—5'.

DETAILED DESCRIPTION OF THE INVENTION

Figure 1:
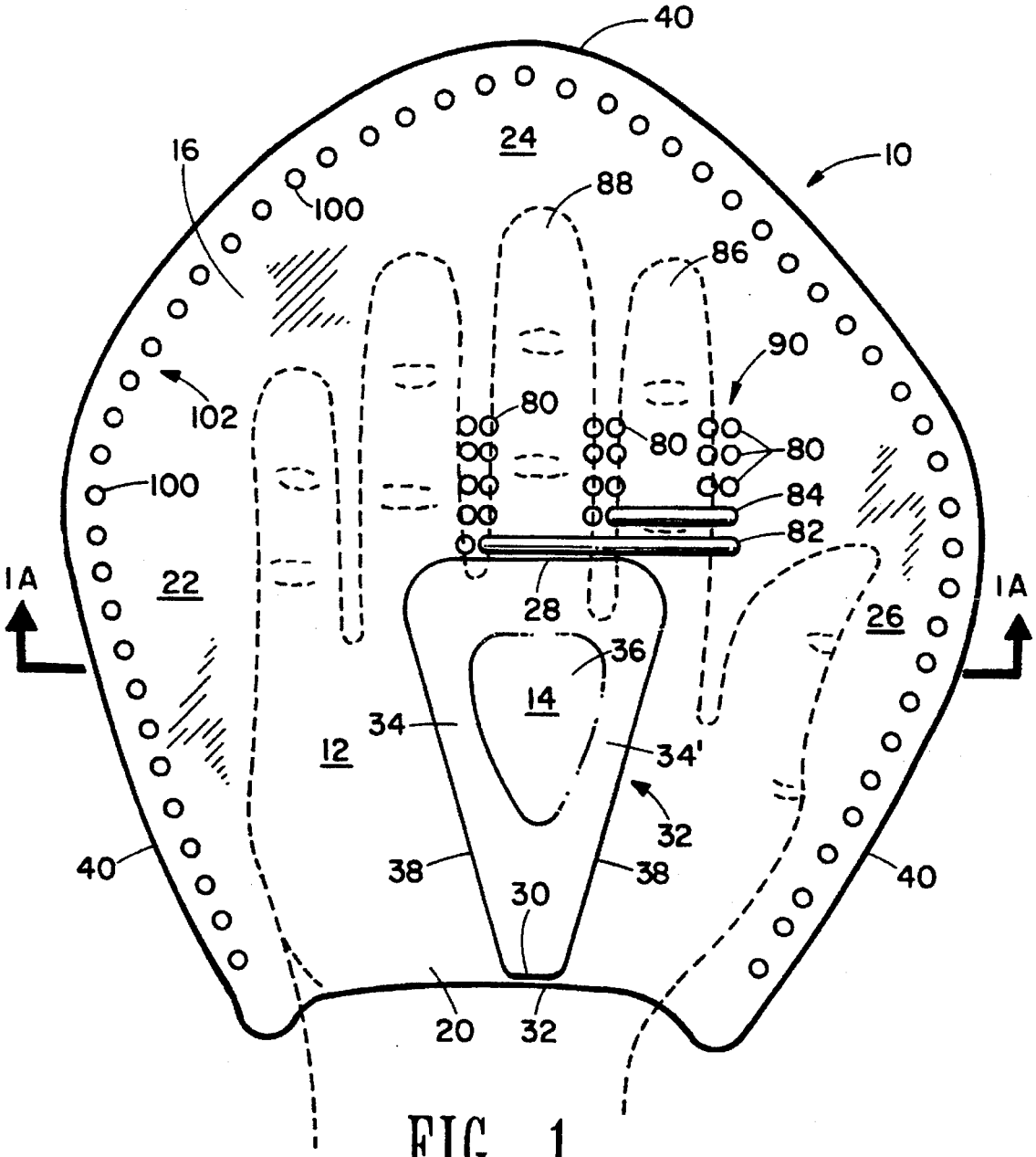
FIG. 1 is a plan view of one embodiment of a left hand paddle of the present invention (the right hand paddle is a mirror image and is not shown)

The inventors have found that an improved hand paddle for training swimmers can be prepared by including in the paddle a raised portion extending from a finger position located on the paddle near to where a first finger joint of a swimmer's hand would rest on the paddle to a palm position on the paddle and where the raised portion tapers from the finger position to the palm position.

The raised portion can either be a separate element attachable (either permanently or detachably) to a pre-made paddle element or be an integral part of the paddle. The form or shape of the raised portion is to allow for proper hand positioning on the paddle and, simultaneously, to conform the hand to a shape designed to maximize stoke efficiency in the absence of the paddle, i.e., to place the hand in a proper cupped form.

The raised portion has a substantially straight finger portion extending across at least a middle finger and a ring finger of the swimmers hand and tapering to a V-shaped or rounded V-shaped point at or near a middle area of a palm portion of the paddle. The palm portion of the paddle is generally of a concave shape to accommodate the swimmer's wrist and to provide the wrist with a full range of motion.

Although the paddle can be of any shape provided the paddle adequately accommodates a swimmer's hand, the paddle preferably outlines the hand with a substantially flat portion that extends from the raised portion out past the hand outline, i.e. , the paddle is larger than the hand. Preferably, the flat portion does not uniformly extend past the hand outline, but is wider than the hand outline by an off-set (the distance from the hand outline to the paddle's edge) which is not uniform.

Instead, the flat portion has a greater extension or off-set on the non-thumb side of the hand. This greater extension on the non-thumb side of the paddle requires the swimmer to exert a greater amount of force on the non-thumb side of the paddle to keep the paddle's water side face substantially perpendicular to the direction the swimmer is progressing through the water. The greater mount of force in mm more effectively exercises certain muscle groups in the fore and upper arm to improve the swimmer stroke and power.

On the thumb side of the paddle, the flat portion more closely approaches the outline of the hand when the hand is properly positioned on the paddle than, as stated above, does the flat portion on the little finger side of the paddle which has a larger off-set area. While, the flat portion extends above the finger tips an mount equal to or less than the off-set on the non-thumb side of the paddle.

Additionally, the paddle can have any desired contour provided that the off-set on the little finger side of the paddle is greater than the off-set on the thumb side of the paddle. The contour can also optionally include indentions or valleys to lower resistance or to change the dynamics of the paddle as it is pushed through the water during a swimmer's stoke. However, a somewhat oval shape is preferred with generally rounded corners.

The paddle of the present invention also includes a first plurality of holes or perforations, which are designed to accommodate a single finger strap and a double finger strap with the double finger strap preferentially disposed on the palm side of the single finger strap. The plurality of holes are laid out to fit various hand shapes for a given size paddle.

Of course, the present invention contemplates a set of paddle sizes and a set of paddles with different relative thumb, non-thumb and finger tip off-sets associated therewith. Additionally, the present invention contemplates a number of different shapes and sizes for the raised portion of the paddle to accommodate different hand shapes and sizes or simply to satisfy one swimmer's preference over another's.

The paddle of the present invention may also include a second plurality of holes, perforations or slots in the paddle either associated with the flat or raised portions of the paddle or the perforations can be associated with both portions. The second plurality of perforations are designed to augment or reduce the resistance characteristics of the paddle and to augment the flow characteristic of the water around and through the paddle as the paddle is pushed through the water.

Preferably, the second plurality of holes or perforations are associated with the flat portion of the paddle and more particularly, with the off-set regions of the paddle and especially with the part of the flat portion nearer the paddle edge than the hand. The second plurality of perforations are generally depicted as being round in the Figures, but these holes or perforations can be of any desired shape including oval-shaped, elongated slots, diamonds, squares, triangles or the like or any combination thereof.

Although the paddle of the present invention can be made of a plastic material having a modulus of elasticity of about 130,000 p.s.i. and a thickness of about 2 to about 4 mm and preferably 3 mm, the paddles of the present invention are preferentially made of higher modulus materials including composites or laminants such as fiber glass composites, reinforced plastic composites or graphite composites. Construction of the paddles out of these materials in conjunction with the raised palm portion of the paddles of the present invention provides a more durable form fitting paddle. Additionally, the paddles of this invention can be individually manufactured for a particular person's hand by making a cast of the swimmer's hand and using the cast as a mold to prepare the raised and flat portion of the paddle.

Referring now to FIG. 1, a first embodiment of a paddle, generally 10, of this invention is shown. The paddle 10 can be cut from a flat sheet of plastic material or molded using either conventional injection technology as is well known in the art or injection molding technology which is also well known in the art. The paddle 10 can be of any desired modulus or stiffness, but is preferentially stiff enough to resist stress fatigue from continuous flexing. One problem with paddles made of relatively flexible plastic materials is that the paddle fatigues and breaks frequently. The present paddles because of the raised palm portion can be manufactured of higher modulus materials and still achieve the same relative feel of the more flexible paddles not having the raised palm portion. In fact, one preferred material for making the paddles of the present invention is a clear fiber glass composite so that team or supplier logos can be laminated therein or embossed thereon. Additionally, other types of composites, laminants and the like can be used such as a graphite composites or other highly reinforced composites or filled plastics such as silica filled nylon or the like. Additionally, the paddles can be made out of any material that has sufficient stiffness and/or elelasticity to make a suitable paddle. Of course, the paddle can also be of any color or any combination of colors including team colors and the like.

The paddle 10 of this invention includes a ,middle portion 12, a raised portion 14 contained within the middle portion 12, a flat portion 16 extending from the raised portion 14 out past an outline of a swimmer's hand 18, and a palm portion 20. The flat portion 16 has a little finger off-set area 22, a finger tip off-set area 24, and a thumb side off-set area 26. The raised portion 14 has a straight finger joint top 28 tapering to a V-shaped or rounded V-shaped palm bottom 30 located at or near a middle section 32 of the palm potion 20 of the paddle 10.

Figure 1A:
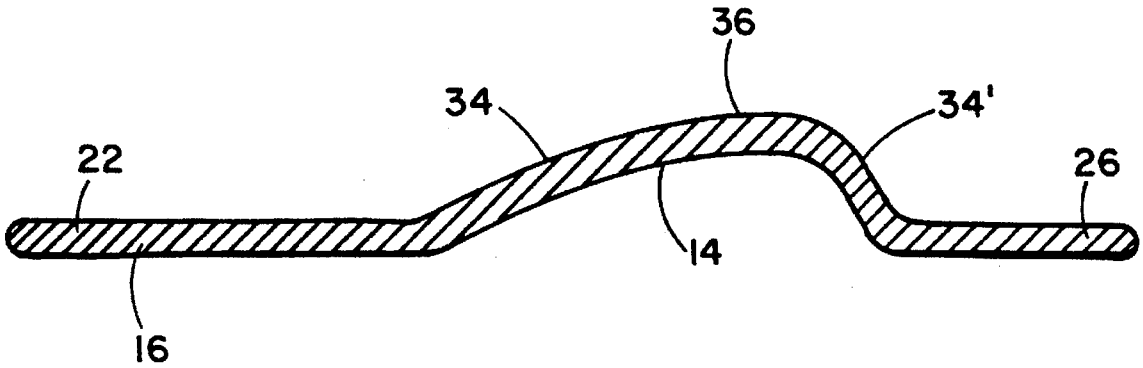
FIG. 1*a* is a cross-sectional view of the paddle of FIG. 1 along line 1—1.

In this embodiment, the raised portion 14 is an integral part of the paddle 10. The raised portion 14 is depicted in this embodiment as a generally symmetric, flattened tear drop shape 32 having generally tapered or convex shoulders 34 and 34' and a rounded top 36 (shown in cross-section in FIG. 1*a* along line 1—1 in FIG. 1). Although, the flat portion 16 is primarily associated with the off-set areas 22, 24, and 26, the flat portion 16 actually extends from a contour 38 of the raised potion 14 (in this example the flattened tear drop shape 32) to a contour edge 40 of the paddle the 10. As shown in FIG. 1, the paddle 10 is raised on a hand side 42 of the paddle 10 and recessed on a water side 44 of the paddle 10. However, the paddle 10 could also be flat on the water side 44 and the interior of the raised portion could be filled with a water repellant, blown foam to give the paddle 10 increase buoyance. Preferably, the thumb side shoulder 34' has a greater grade than the top and little finger shoulder 34 so that the thumb shoulder 34' forms a thumb rest. More particularly, the thumb shoulder 34' a grade is between about vertical (90°) and about 75° with a grade between about 90° and 80° being preferred, and the shoulders 34 slope at an angle between about 15° and about 65°, with an angle between about 30° and about 60° being preferred and an angle between about 30° and 45° being particularly preferred, but greater and smaller slopes can be used as well. The shoulder 34' can even have an angle of greater than 90°, i.e., the shoulder 34' would be beveled in instead of beveled out.

Generally, the raised portion 14 is of a sufficient height to force the hand comfortably into a proper cupped shape with the raised potion 14 having a height between about ¼" to about ¾" at its top 36. Preferably, the height of the flattened top 36 is between about ⅜" and ⅝". Of course, lower and higher raised portions 14 can be used with only comfort being a controlling factor. Additionally, the raised potion 14 does not have a constant height because the raised portion tappers into the flat portion 16 of the paddle.

Figure 2:
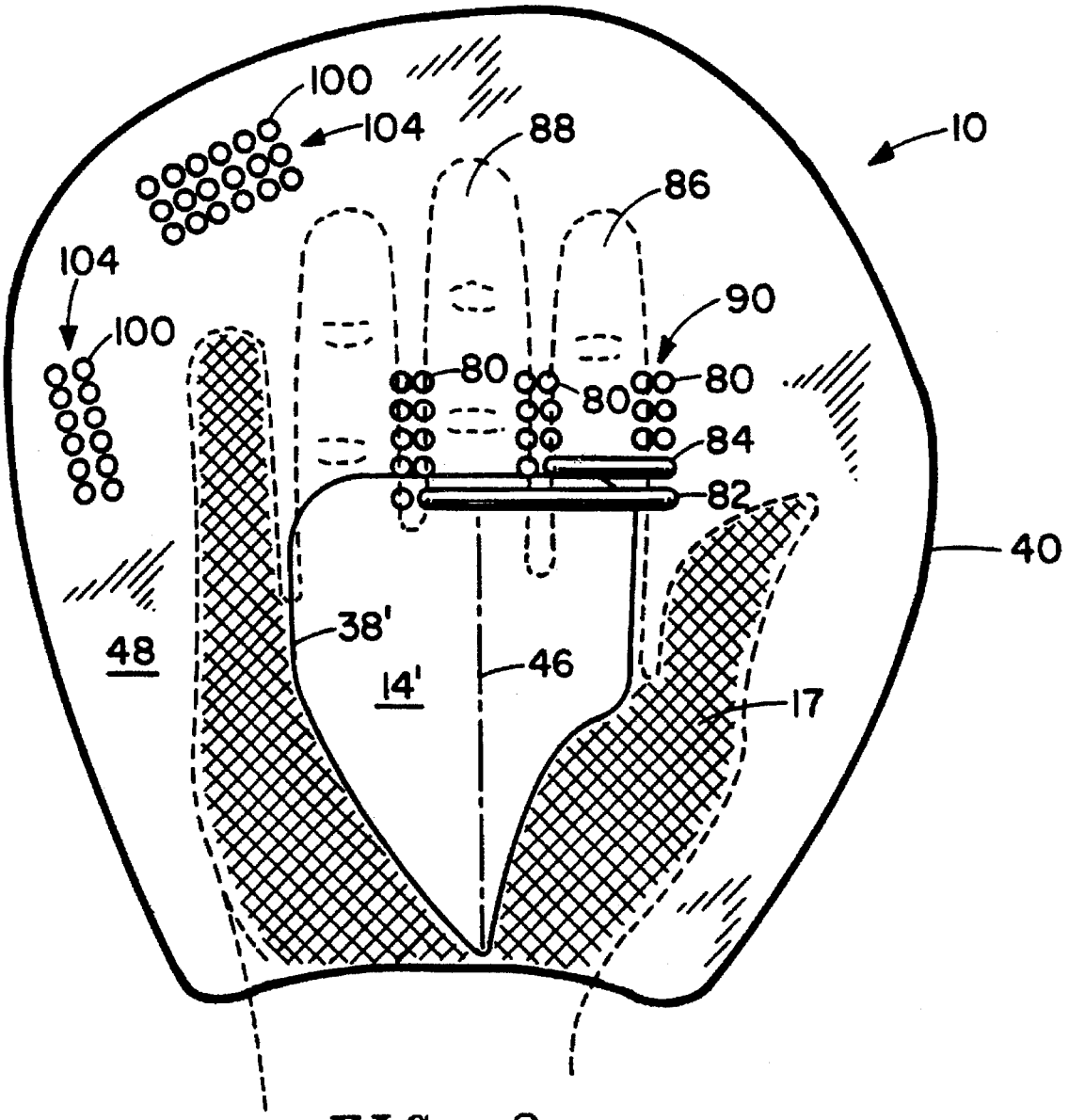
FIG. 2 is a plan view of a second embodiment of a left hand paddle of the present invention.
Figure 3A:
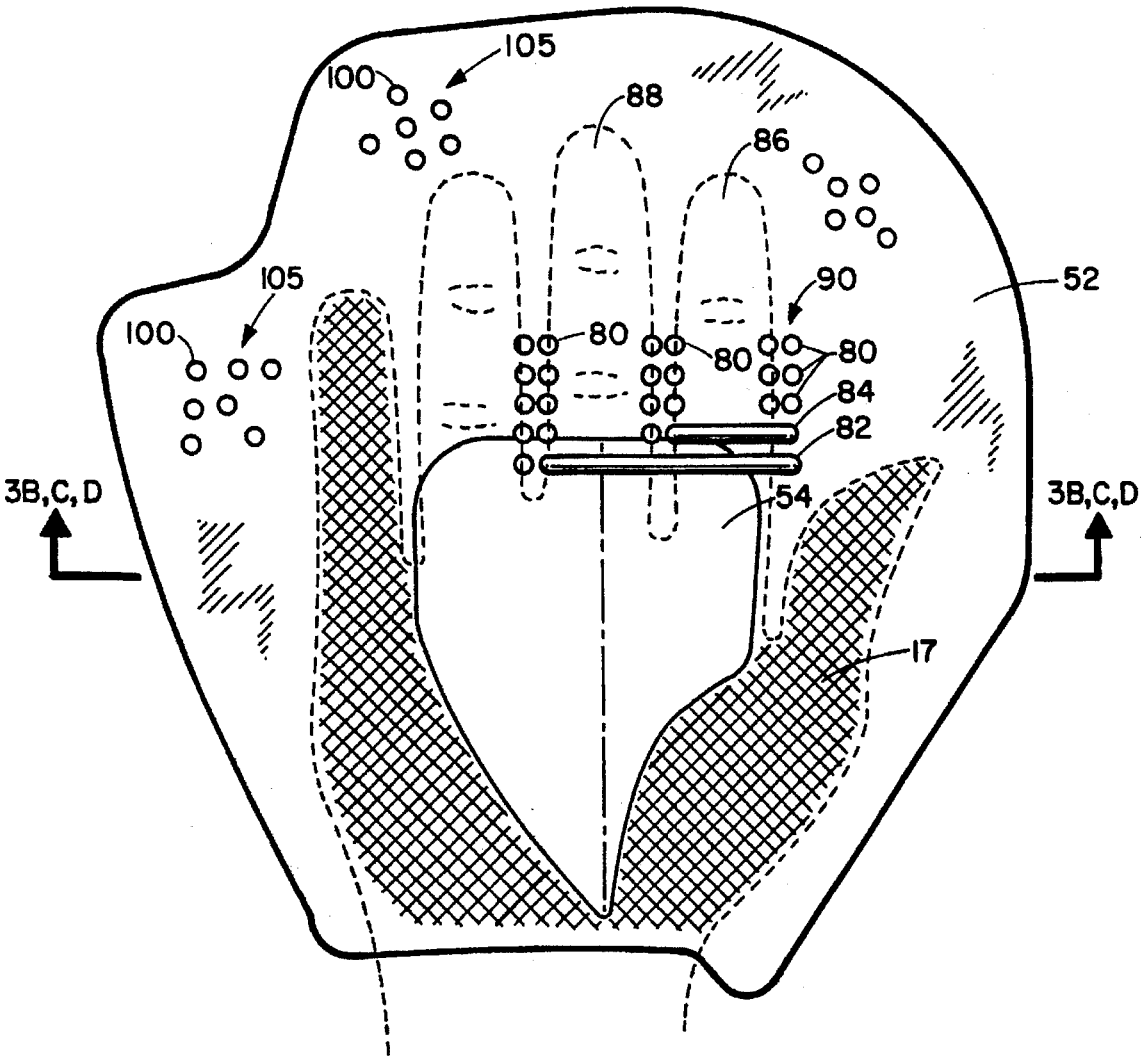
FIG. 3*a* is a plan view of a third embodiment of a left hand paddle of the present invention.

It should also be apparent that a swimmer's hand (shown in fathom) makes contact with the flat portion 16 of the paddle 10 in an essentially backward 'J' shaped contact area 17 as shown in FIGS. 2 and 3*a*. The backward J contact area 17 extends basically from the little finger to the thumb.

Looking now at FIG. 2, a second embodiment of this invention can be seen as a paddle 10 having a different contour edge 40 than the paddle of FIG. 1. Additionally, the contour 38' of the raised portion 14' can be seen to be different than the flattened tear drop shape 32 of FIG. 1. The new contour 38' more closely approximates a cupped hand shape being substantial asymmetric about a center line 46 of the raised potion 14' with a greater amount of the raised portion 14' associated with the little finger side 48 of the raised portion 14'.

Figure 3B:
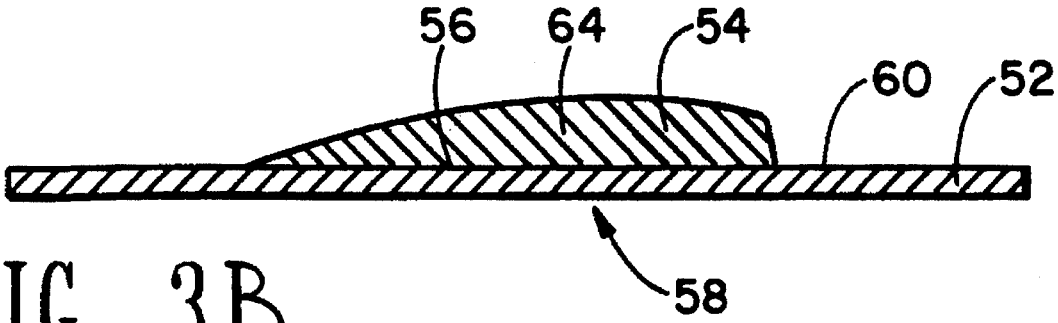
FIG. 3*b* is a cross-sectional view of the paddle of FIG. 3*a* along line 3—3 depicting a bonded palm member.

Referring now to FIG. 38, another embodiment of a paddle, generally 50, of the present invention can be seen to include a flat paddle member 52 and a palm member 54. The palm member 54 can have any desired shape as can the raised portions 14 or 14' of FIGS. 1 and 2 provided, of course, that the palm member 54 or the raised portions 14, 14' serve to properly position the hand on the paddle and maintain the hand in a proper cupped shape to improve stroke efficiency. The palm member 54 includes a substantially flat bottom surface 56 designed to attachably engage a middle portion 58 of the flat paddle member 52 on its top surface 60 as shown in cross-section in FIG. 3*b*.

Figure 3C:
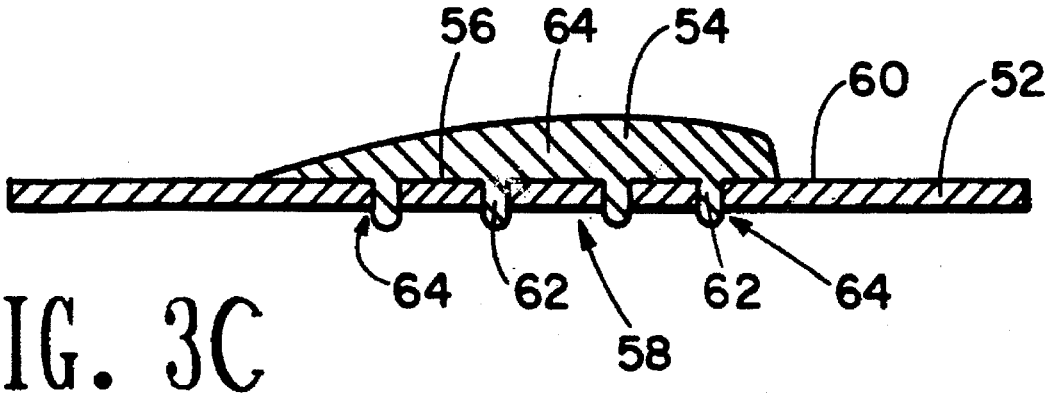
FIG. 3*c* is a cross-sectional view of the paddle of FIG. 3*a* along line 3'—3' depicting a snap in palm member.
Figure 3D:
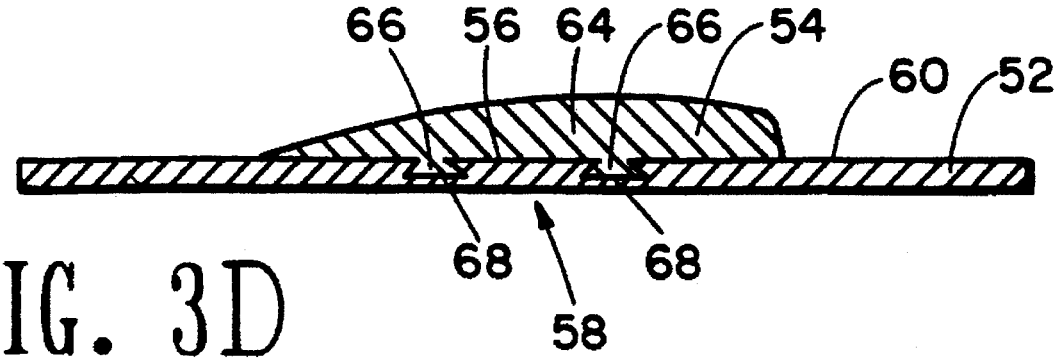
FIG. 3*d* is a cross-sectional view of the paddle of FIG. 3*a* along line 3"—3" depicting a slide in palm member.
Figure 3E:
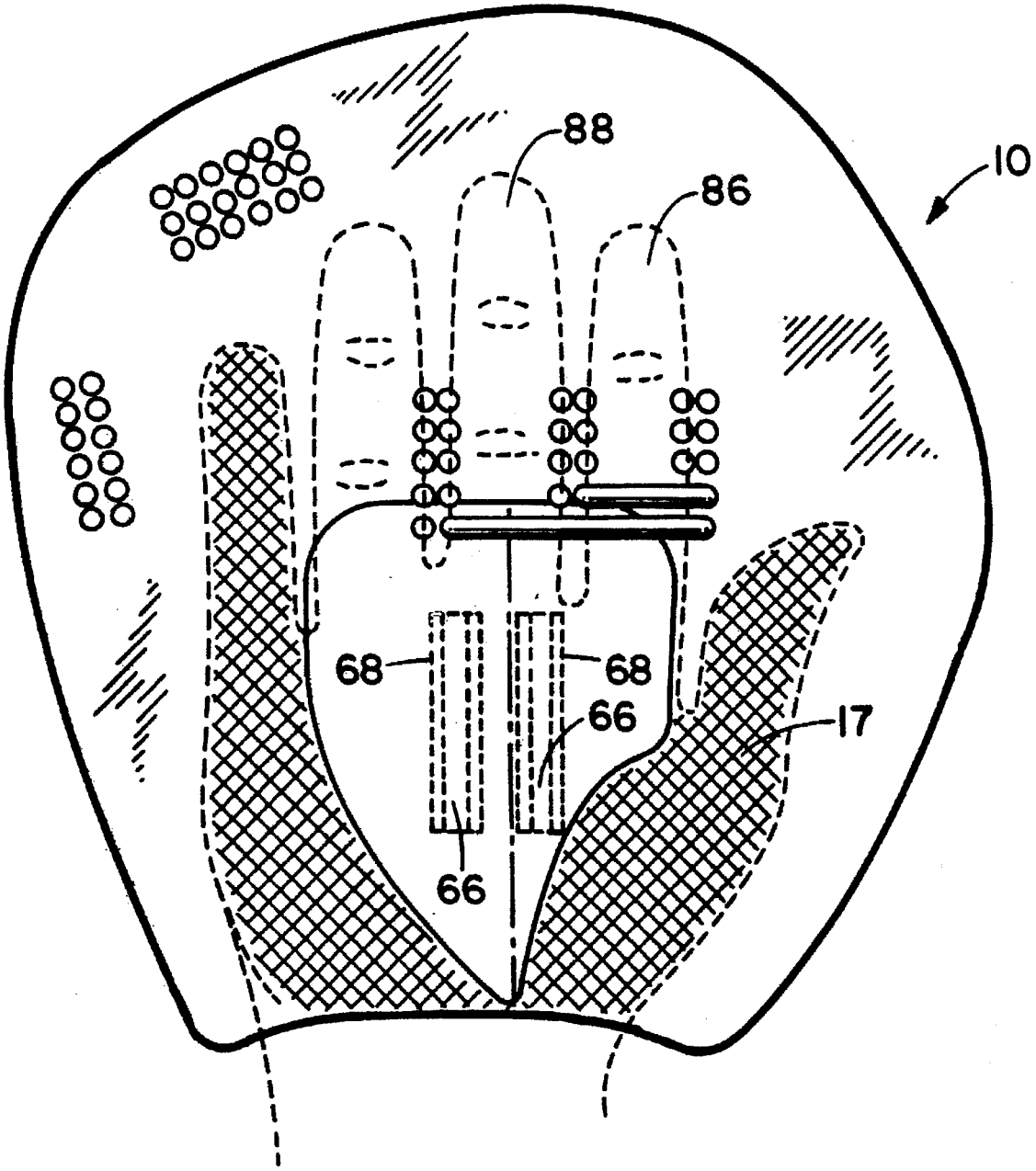
FIG. 3*e* is a plan view of the paddle of FIG. 3*a* with grooves for receiving the slide in palm member for FIG. 3*d;*

The palm member 54 can be attached to the paddle member 52 by any means for attaching known in the art including adhesively bonding, thermal bonding or sonically welding the palm member 54 to the paddle member 52, snapping the palm member 54 having one or more male protrusions 62 (See FIG. 3*c*) designed to engage one or more female indentations or holes 64 in the paddle member 52, or sliding, snapping or inserting the palm member 54 having one or more retention tabs 66 into one or more retention grooves 68 in the paddle member 52 (See FIGS. 3*d* and 3*e*). Of course, other means for attaching can be used as well and it should be recognized that the palm member 54 can be either detachable or non-detachable from the paddle member 52. It should be obvious to one of ordinary skill in the art that a vareity of other attachment procedures can be used. It should also be recognized that the protrusions 62 can extend past the bottom of the paddle once the palm member 54 has been attached to the paddle member 52 as shown in FIG. 3*c*.

The palm member 54 can be made out of the same material as the paddles of Figures and 2 or it can be made from any plastic material such as PVC, polyethylene, polypropylene, or the like. These materials are economical and easy to fashion by such methods as cutting, sawing, thermoforming, bending, drilling, punching, embossing, blow moulding, vacuum forming, welding, gluing, screwing, nailing, and riveting.

Generally, the member 54 will have a maximum thickness of about 0.5 to about 2 cm. However, greater or smaller thickness can be used if needed or desired. Preferably attachable palm member 54 include a blown or foam interior 69 and a hard water resistant outer skin 70 as shown in cross-section in FIGS. 3*b–d* where the bottom skin material must be capable of bonding to the paddle member 52 if the palm member 54 is to be bonded to the paddle member 52. Moreover, the top surface 60 of the palm member 54 or the surface of the raised portion 14 can be textured to better engages the swimmer's hand. Texturing can of any type including cross-hatching, dimpled, corrugated, or the like.

In addition to the other features described above, the paddle 10 of FIGS. 1, 2, and 3*a* also include a first plurality of perforations 80 located and designed to allow a double finger strap 82 and a single finger strap 84 to be threaded therethrough and to engage a swimmer's index and middle fingers 86 and 88 as shown in the Figures (fingers shown in fathom). The straps 82 and 84 are generally made of rubber tubing or other elastic tubing slightly larger in diameter than the perforations 80. The perforations 80 are preferably circular and beveled smooth to prevent damaging the straps 82 and 84. Additionally, the perforations 80 are generally aligned in a grid pattern 90 to allow for variability in finger size and shape. Preferably, the double finger strap 82 is positioned on the palm side of the single finger strap 84 as shown in the Figures. As is shown in FIGS. 1 and 2, at least some of the perforations are located on the raised portion 14 and the remainder are located on the flat potion 16. However, all of the perforation 80 could be located exclusively on either the raised portion 14 or the flat portion 16 or in any distribution on both the raised and flat portions 14 and 16.

Besides the strap perforations, the paddles of the present invention may also include a second plurality of perforations 100 distinct from the strap perforations 80. This second set of perforations 100 can be distributed over the entire paddle, but are preferentially associated with the off-set regions 22, 24, and 26. This second set of perforation 100 can be of any shape including circular, oval, elongated slots, or the like. This second set of perforation 100 are designed to decrease the effective surface area of the paddle and thereby reduce the resistance of the paddle as it is being pushed through the water. The second set of perforations can be arranged in a single row 102 as shown in FIG. 1 following the contour 40 of paddle 10 near the paddle's edge or multiple rows 104 as shown in FIG. 2 or clusters of perforations 105 in different off-set areas as shown in FIG. 3. Of course, the perforation could be more randomly distributed or can include any combination of rowed perforations, clustered perforations or randomly distributed perforations.

Referring now to FIGS. 4*a*, 4*b*, and 4*c*, a first embodiment of a palm piece, generally 200, of the present invention is shown in top and two cross-sectional views. The palm piece 200 includes a flattened tear-drop shape with a substantially straight finger top 202, a V-shaped palm bottom 204, a little finger side 206, a thumb side 208, a rounded top portion 210, a top slope 212 and little finger side slope 213, and a thumb slope 214 and a palm slope 215. Preferably, the thumb side slope 214 has a greater grade than the top slope 212 and little finger slope 213 so that the thumb will have a resting edge 216. More particularly, the thumb slide slope 214 is between about vertical (90°) and about 75°, and between about 90° and 80° being preferred, and the other slopes 212, 213 are between about 15° and about 65°, with slopes between about 30° and about 60° being preferred and slopes between about 30° and 45° being particularly preferred, but greater and smaller slopes can be used as well. The thumb side 208 can even have an angle of greater than 90°, i.e., the thumb side 208 would be beveled in instead of beveled out.

Referring now to FIGS. 5*a*, 5*b*, and 5*c*, a second embodiment of a palm piece, generally 220, of the present invention are shown in top and two cross-sectional views. The palm piece 220 of FIG. 4 has an asymmetric shape with a flatted finger top 222, a V-shaped palm bottom 224, a convex, little finger side 226, and a thumb side 228 having a concave portion 230 and a thumb rest portion 232 which is preferably somewhat rounded or substantially straight. The palm piece 220 further includes a rounded top portion 234, a top side slope 236, a little finger side slop 238, a concave portion slope 240, a palm slope 241 and a thumb rest portion slope 242. Preferably, the thumb rest portion slope 242 has a greater grade than the other slopes 236, 238, 240, 241. More particularly, the thumb rest portion slope 242 is between about vertical (90°) and about 75°, and between about 90° and 80° being preferred, and the other slopes 236, 238, 240 are between about 15° and about 65°, with slopes between about 30° and about 60° being preferred and slopes between about 30° and 45° being particularly preferred, but greater and smaller slopes can be used as well.

Additionally, the palm pieces of FIG. 4 and 5 can also include holes 250 corresponding to holes 100 in FIG. 1 designed to align with perforations in a prior art paddle and to engage the elastic tubing that form the straps that hold the swimmers hand to the paddle.

In addition to the traditional uses for which prior art paddles were employed, the paddles of this invention are useful for synchronized swimming, surfing, triathlon, masters competition, long distance swimming lessons, medical rehabilitation, general recreation and water exercises in general. The paddles are helpful in teaching and learning proper stroke techniques because the user can feel the stroke better and the coach can see the stroke better. The size in conjunction with the raised portion of the paddle contribute to this advantage.

Moreover, the paddle urges the user to follow through at the end of the stroke because the resistance of the paddle both reminds and impedes early recovery. Another advantage is that the paddle teaches streamlining when pushing off the pool wall. If the swimmer's arms are not together the paddles pull them apart. The paddles also facilitate learning the proper hip mm in flee style. The paddles make it impossible to avoid hitting the thighs if the hips are not tamed properly.

It is to be understood that the paddles are used in pairs and that a second paddle for the opposite hand is provided in sets and represent mirror images of each other. For convenience, only one of the two paddles is shown in the drawings. Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

We claim:

1. A swimmer's hand paddle comprising:

a. a raised portion extending from a finger position located near a first finger joint of a swimmer's hand as the hand is positioned properly on the paddle to a palm position of the paddle, where the raised portion tapers from the finger position to the palm position and where the raised portion is designed to properly position the hand on the paddle, to shape the hand in a proper form to maximize stroke efficiency, to provide better paddle-hand contact and to provide better paddle control;

b. a substantially flat portion that extends from the raised portion out past an outline of the swimmer's hand and having a thumb off-set, a little finger off-set and a finger tip off-set; and c. a first plurality of perforations to accommodate a single finger strap designed to engage either a middle finger or a index finger of the swimmer's hand and double finger strap designed to engage both the middle and index fingers of the swimmer's hand, where the straps are designed to secure the swimmer's hand to the paddle.

2. The paddle of claim 1, wherein the paddle is substantially oval shaped with a concave palm contour and wherein the little finger off-set is larger than the thumb off-set.

3. The paddle of claim 1, wherein the first plurality of perforations comprise a closely spaced array or grid pattern of perforations approximating the location of the middle and index fingers, located in both the raised and flat portions of the paddle and wherein the double finger strap is closer to a palm portion of the paddle than the single finger strap.

4. The paddle of claim 1, further comprising:

d. a second plurality of perforation to allow water to pass therethrough designed to reduce or augment the paddle's resistance as it is pushed through the water.

5. The paddle of claim 4, wherein the perforations of the second plurality are distributed throughout the entire paddle.

6. The paddle of claim 4, wherein the perforations of the second plurality are located in the flat portion of the paddle.

7. The paddle of claim 4, wherein the perforations of the second plurality are located in the off-set regions of the flat portion of the paddle.

8. The paddle of claim 1, wherein the raised portion includes:

i. a substantially flat bottom side for attachably engaging said paddle;

ii. a rounded top portion;

iii. a substantially straight finger edge iv. a little finger side edge;

v. a thumb side edge;

vi. a V-shaped palm base edge;

vii. shoulders sloping from the top portion to the edges; and viii. at least two holes aligned with holes on said paddle and designed to engage a finger strap; and where the slope of the shoulder associated with the thumb side edge is steeper than the slopes of the shoulders associated with the other edges and wherein the slope of the shoulder associated with the thumb side edge is between about 90° and about 75° and the other slopes of the shoulders associated with the other edges are between about 15° and about 65°.

9. The paddle of claim I, wherein the raised portion includes:

i. a substantially straight finger edge including a first shoulder having a slope;

ii. a substantially straight upper thumb side edge designed to form a thumb rest including a second shoulder having a second slope;

iii. a concave lower thumb side edge including a third shoulder having a third slope;

iv. a convex little finger edge including a fourth shoulder having a fourth slope;

v. a V-shaped palm base edge including a fifth shoulder having a fifth slope;

vi. a substantially flat bottom side designed for attachably engage said paddle on said paddle's top side;

vii. a rounded top portion from which the shoulders extend to the edges; and viii. at least two perforations designed to align with perforations on said paddle and to engage one or more finger straps to secure the hand to the paddle; and where the second slope of the second shoulder is steeper than the slopes of the other shoulders and wherein the second slope is between about 90° and about 75° and the other slopes are between about 15° and about 65°.

10. A swimmer's hand paddle comprising:

a. a substantially flat member having a thumb off-set, a non-thumb off-set and a finger tip off-set;

b. a raised member attachably engaging a middle region of the flat member and extending from a finger position located near a first finger joint of a swimmer's hand positioned properly on the paddle to a palm position of the paddle, where the raised member tapers from the finger position to the palm position and where the raised member is designed to properly position the hand on the paddle, to shape the hand in a proper form to maximize stroke efficiency, to provide better paddle-hand contact and to provide better paddle control; and c. a first plurality of perforations to accommodate a single finger strap designed to engage either a middle finger or a index finger of the swimmer's hand and double finger strap designed to engage both the middle and index fingers of the swimmer's hand, where the straps are designed to secure the hand to the paddle where the double finger strap is closer to a palm portion of the paddle than the single finger strap.

11. The paddle of claim 10, wherein the paddle is substantially oval shaped with a concave palm contour, wherein the little finger off-set is larger than the thumb off-set; wherein the raised member detactably engages the flat member.

12. The paddle of claim 10, further comprising:

d. a second plurality of perforation to allow water to pass therethrough reducing or augmenting the paddle's resistance as it is pushed through the water.

13. The paddle of claim 10, wherein the perforations of the second plurality are distributed throughout the entire paddle.

14. The paddle of claim 10, wherein the perforations of the second plurality are located in the off-set regions of the flat portion of the paddle.

15. The paddle of claim 10, wherein the raised portion includes:

i. a substantially flat bottom side for attachably engaging said paddle;

ii. a rounded top portion;

iii. a substantially straight finger edge iv. a little finger side edge;

v. a thumb side edge;

vi. a V-shaped palm base edge;

vii. shoulders sloping from the top portion to the edges; and viii. at least two holes aligned with holes on said paddle and designed to engage a finger strap; and where the slope of the shoulder associated with the thumb Side edge is steeper than the slopes of the shoulders associated with the other edges and wherein the slope of the shoulder associated with the thumb side edge is between about 90° and about 75° and the other slopes of the shoulders associated with the other edges are between about 15° and about 65°.

16. The paddle of claim 10, wherein the raised portion includes:

i. a substantially straight finger edge including a first shoulder having a slope;

ii. a substantially straight upper thumb side edge designed to form a thumb rest including a second shoulder having a second slope;

iii. a concave lower thumb side edge including a third shoulder having a third slope;

iv. a convex little finger edge including a fourth shoulder having a fourth slope;

v. a V-shaped palm base edge including a fifth shoulder having a fifth slope;

vi. a substantially flat bottom side designed for attachably engage said paddle on said paddle's top side;

vii. a rounded top area from which the shoulders extend to the edges; and viii. at least two perforations designed to align with perforations on said paddle and to engage one or more finger straps to secure the hand to the paddle; and where the second slope of the second shoulder is steeper than the slopes of the other shoulders and wherein the second slope is between about 90° and about 75° and the other slopes are between about 15° and about 65°.

17. A palm piece for use with a swimmer's hand paddle comprising:

a. a substantially flat bottom side for attachably engaging said paddle;

b. a rounded top portion;

c. a substantially straight finger edge d. a little finger side edge;

e. a thumb side edge;

f. a V-shaped palm base edge;

g. shoulders sloping from the top portion to the edges; and h. at least two holes aligned with holes on said paddle and designed to engage a finger strap; and where the palm piece is designed to extend from a finger position of said paddle located near a first finger joint of a swimmer's hand when the hand is properly positioned on said paddle to a palm position of said paddle and to properly position the hand on the paddle, to shape the hand in a proper form to maximize stroke efficiency, to provide better paddle-hand contact and to provide better paddle control.

18. The paddle of claim 17, wherein the slope of the shoulder associated with the thumb side edge is steeper than the slopes of the shoulders associated with the other edges wherein the slope of the shoulder associated with the thumb side edge is between about 90° and about 75° and the other slopes of the shoulders associated with the other edges are between about 15° and about 65°.

19. A palm piece for use with a swimmer's hand paddle comprising:

a. a substantially straight finger edge including a first shoulder having a slope;

b. a substantially straight upper thumb side edge designed to form a thumb rest including a second shoulder having a second slope;

c. a concave lower thumb side edge including a third shoulder having a third slope;

d. a convex little finger edge including a fourth shoulder having a fourth slope;

e. a V-shaped palm base edge including a fifth shoulder having a fifth slope;

f. a substantially flat bottom side designed for attachably engage said paddle on said paddle's top side;

g. a rounded top area from which the shoulders extend to the edges; and h. at least two perforations designed to align with perforations on said paddle and to engage one or more finger straps to secure the hand to the paddle; and where the palm piece is designed to extend from a finger position of said paddle located near a first finger joint of a swimmer's hand when the hand is properly positioned on said paddle to a palm position of said paddle and to properly position the hand on the paddle, to shape the hand in a proper form to maximize stroke efficiency, to provide better paddle-hand contact and to provide better paddle control.

20. The paddle of claim 19, wherein the second slope of the second shoulder is steeper than the slopes of the other shoulders and wherein the second slope is between about 90° and about 75° and the other slopes are between about 15° and about 65°.

* * * * *